United States Patent [19]

Moore et al.

[11] 4,074,005

[45] Feb. 14, 1978

[54] FLOCK TREATMENT

[75] Inventors: Ricky L. Moore, Atlanta; Winston E. Hagborg, Columbus, both of Ga.

[73] Assignee: West Point-Pepperell Inc., West Point, Ga.

[21] Appl. No.: 659,629

[22] Filed: Feb. 20, 1976

[51] Int. Cl.[2] ..... B05D 5/08; B05D 7/02; B05D 1/18

[52] U.S. Cl. ..... 428/378; 427/212; 427/222; 427/384; 427/394

[58] Field of Search ..... 427/222, 212, 384, 394; 428/378, 90; 252/383

[56] References Cited

U.S. PATENT DOCUMENTS

| | | | |
|---|---|---|---|
| 3,490,938 | 1/1973 | Hoover et al. | 428/90 X |
| 3,755,450 | 8/1973 | Anderson et al. | 252/383 X |

*Primary Examiner*—James R. Hoffman

*Attorney, Agent, or Firm*—Cushman, Darby & Cushman

[57] ABSTRACT

Flock is treated with a metal salt of a long chain aliphatic acid to control static charges, increase flow and reduce waste. The salt may be applied from a water solution, or from an aqueous mixture of the metal and the acid under high shear mixing conditions under which at least a part of the acid is converted to the salt.

22 Claims, No Drawings

FLOCK TREATMENT

The present invention relates to treatment of flock to facilitate screening the flock, reduce waste, and improve the uniformity and the density of the flocked surface of the fabric produced from the flock. Briefly, the invention comprises adding a linear organic carboxylic acid containing at least 8 and preferably at least 10–14 carbon atoms to water in which the flock is dispersed, the water containing a small amount of a divalent metal cation such as cation of group II A or B of the periodic table of elements, for example calcium, zinc, etc., or adding the acid in the form of a salt of a group II metal, and separating and drying the flock. Preferred acids are those containing 14–18 carbon atoms. The invention also permits the use of other ions, such as trivalent and monovalent metals, but, although they give beneficial results, their performance is less favorable than divalent metal ions.

Flock is made by cutting short lengths of fiber 0.05 to 1.5 inches long from continuous filaments of 1.5 to 40 denier per filament (dpf) of synthetic or man-made polymer. Best results are usually obtained with filaments of 3–15 dpf cut to lengths of 1–8 mm, preferably 3 dpf cut to 2 mm length. Generally longer lengths require higher deniers to provide the necessary stiffness. A particularly useful process for cutting flock is described in U.S. application of Winston E. Hagborg, Ser. No 437,617, filed Jan. 29, 1974, now U.S. Pat. No. 3,916,040. In the process described in that application, a tow is scoured to remove previously applied finishes, and rinsed. While still in wet condition, the tow is directed to a cutter which cuts it into fibers of the desired length. Either prior to or after the cutting step, the fibers are subjected to a finishing operation in which suitable chemicals are applied.

The flock then is applied onto a substrate by screening it and passing it through an electrostatic field. Under the influence of the field, the flock is directed onto a surface in an orientation perpendicular to the backing and bonded with adhesive. See U.S. Pat. No. 3,490,938 and publications cited there.

In accordance with the present invention, the tow from which the flock is cut, but preferably the flock itself after cutting, is treated with a salt of a metal ion with a linear saturated aliphatic monocarboxylic acid containing at least 8 carbon atoms, with or without prior scouring, in an amount effective to improve the flow of the flock, as hereinafter defined. The salt may be applied directly, or alternatively, the flock may be treated with a linear saturated aliphatic monocarboxylic acid containing at least 8 carbon atoms while dispersed in water, which contains a low concentration of the metal ion. The latter procedure requires hot water and high shear mixing to facilitate ion/acid reaction.

The invention is particularly applicable to flock composed of synthetic polymers, such as flock composed of linear polyester of the type having repeating units connected by ester linkages in the polymer chain (e.g., polyethylene terephthalate and its copolymers), flock composed of polyamide (nylon) of the type having a repeating units connected by amide linkages in the polymer chain (i.e., nylon 66, nylon 6, etc.) and flock composed of polyolefin (i.e., polyethylene, polypropylene, etc.). The invention also has been found useful with flock cut from man-made filaments including rayon, cellulose acetate and cellulose triacetate.

The linear saturated aliphatic monocarboxylic acid used in the present invention has at least 8 carbon atoms and may be, e.g., palmitic acid, stearic acid, myristic acid and arachidic acid. Mixtures of such acids may be used. Examples of commercially available acids are Emery 132, 150 and 153. For reasons of cost, acids containing more than 20 carbon atoms are unattractive. Experiments have revealed that salts in which the acid contains 8 carbon atoms are of marginal usefulness, acids containing 10 carbon atoms give good results, but acids containing 12–14 carbon atoms or more are especially preferred. Mixtures of acids may be used. Appropriate esters of these acids which either contain or saponify to give free acid may also be used.

The metal ions preferably are divalent metal ions. These may be ions derived from metals of group II A or B (see Periodic Table of the Elements, *Handbook of Chemistry and Physics,* 44th Edition, Chemical Rubber Publishing Co., pages 448–449, Groups II*a* and II*b*). These include divalent ions of zinc, calcium, or magnesium. However, divalent metal ions derived from other metals may be used such as lead, manganese, barium, nickel, iron, and tin. Beneficial results also are obtained with monovalent and trivalent metals such as lithium and aluminum, but they are not equal to the results with divalent metals.

The amount of acid used is between about 0.025 to 0.4 g/liter of water in the treating solution at a fiber concentration of 20 g/l; preferably in the case of stearic acid the amount is 0.05 to 0.2 g/liter. If excess acid is used, in relation to the amount of metal ion, poor results are observed because free acid starts to deposit on the fibers in preference to the salt, apparently with the fatty end of the acid deposited against the fibers, and the hydrophilic end of the molecule extending from the fibers. The acid is applied in water containing greater than about 3 parts per million of the divalent metal ion. The metal ion may be introduced in the form of a soluble salt, such as a chloride, or it may represent natural hardness in the water. Preferably, however, the acid is applied in the form of a preformed salt of a divalent metal and calcium stearate is especially preferred because of its low cost, ready availability and effectiveness. In the case of using a preformed salt, the concentration of the salt used is about the same as for the acid, preferably greater than 0.1 g/l at a fiber concentration of 20 g/l. Higher concentrations of fibers make the mixture thicker and hard to stir; they require more of the salt. At lower fiber concentration, less salt may be used. When preformed salt is used, excess salt causes no difficulty except for possible dust problems arising from dust of the excess salt coming off the fibers.

The water containing a preformed metal salt of the acid may simply be agitated with the flock, using sufficient water to thoroughly wet the flock. The water may be at 50° F or higher temperature. On the other hand, when the free acid is used with water containing metal ions, it has been found necessary to suspend the fibers in the water and subject the suspension to mixing in a high shear mixer at a temperature of at least about 48° C. This procedure has been carried out using a Daymax ultra high speed mixing machine purchased from Day Mixing, 4932 Beech St., Cincinnati, Ohio. On a laboratory scale, suitable conditions can be achieved in a Waring blender.

These conditions are believed to disperse the free acid, which is water insoluble, and facilitate chemical reaction between it and the metal ions (see Blodgett, Journal of the American Chemical Society, Vol. 57, page 1007 (1935), and Langmuir, Journal of the American Chemical Society, Vol. 58, page 284 (1936)). $C_{14}$ tracer studies show this procedure appears to deposit a mixture of free acid and metal salt, which is believed to result in a surface composed of hydrophobic $CH_3$-end groups. It is less desirable than using the metal salt, because it requires substantial capital investment for high shear mixing equipment and also because the water must be heated to a temperature of about 48° C or more. Both procedures are believed to form a monomolecular film of salt or salt mixed with free acid on the flock. It also has been found possible to apply the acid itself or the preformed salts from solutions in organic solvents.

The following examples illustrate the process, all parts and percentages being by weight.

EXAMPLE 1

To 1 liter of water there is added 20 grams of 3 dpf/2 mm prescoured flock (scoured and rinsed prior to cutting) and then there is added with mixing 0.15 to 0.3 grams of calcium stearate. The liquid is agitated for about 30 seconds and then the flock is spun and dried to a moisture content of about 4.5%. At this point the flock has a volume resistivity of about $10^{12}$ to $10^{13}$ ohm-cm, as measured by placing a 2 gram sample between parallel copper electrodes in a dielectric cell, with a potential of 500 volts applied. Resistivity is measured on a megohmmeter.

Flock performance for this size flock is measured by adding 15 grams of fibers to a cylindrical container whose bottom consists of a #12 mesh U.S. Standard sieve. A rotating brush is lowered to screen level and the sample is brushed for 300 rotations of the brush. The percentage of fibers passing through the screen is determined by weighing and recorded as percent flow.

Static charge is evaluated empirically by the amount of flock adhering to the sieve used in measuring flow. An arbitrary scale is used with zero indicating lowest static and 5 the highest level observed.

Samples also were evaluated with an AC-DC flocking unit made by C-Labs, Inc. This consists of a screen having round holes approximately the same diameter as a 12 mesh sieve. Below the screen is a series of cylindrical electrodes coated with dielectric material which generate an electric field 40–50 K.V. A.C. Below these electrodes, there is a fabric coated with adhesive which moves below the screen while the screen is brushed with a rotating brush.

This procedure has been used with Nylon 6, Nylon 66, polyethylene terephthalate and rayon flock, and, with slightly higher concentrations of the salt, with polypropylene, cellulose acetate and cellulose triacetate flock. Flows of greater than 95% have been observed. Similar results were observed with 1.5 denier nylon and rayon flock cut to 2 mm.

EXAMPLE 2

The following results are from the treatment of 80 gram samples of fiber (3 dpf/2 mm) in 4 liters of deionized $H_2O$ at room temperature and containing the specified concentrations of calcium stearate, 1 minute treatment times at very low mixing conditions. The measurement were performed as described above. Two numbers are given, the first being the present flow and the second being the static charge on the aforesaid arbitrary scale.

Table 1

| Calcium Stearate Concentration (Grams per Liter) | Nylon 66 | Nylon 6 | Polyester (Polyethylene Terephthalate) | Polypropylene | Rayon |
|---|---|---|---|---|---|
| .02 | 33-4 | 45-4 | 29-4 | 11-4 | 96-0 |
| .09 | 33-4 | 75-2 | 56-4 | 31-4 | |
| .11 | 75-2 | 94-1 | 70-3 | 32-3 | 96-0 |
| .13 | 77-2 | 96-0 | 94-2 | 64-2 | |
| .15 | 94-1 | 96-0 | 97-0 | 70-1 | |
| .22 | 97-0 | 97-0 | 96-0 | 74-1 | 97-0 |
| .30 | 97-0 | 98-0 | 96-0 | 85-1 | |
| .40 | 97-0 | 96-0 | | 96-0 | 98-0 |

When similar experiments were carried out with zinc stearate and magnesium stearate, very little difference in performance was found.

EXAMPLE 3

The following results were observed when various finishes were tested in the manner described above on Nylon 66 flock (3 dpf/2 mm). The two numbers given are respectively percent flow and static charge.

Table 2

| Conc. (g/l) | $ZnSt_2$ | $MgSt_2$ | LiSt | NaSt | $AlSt_3$ |
|---|---|---|---|---|---|
| .09 | 46-3 | 45-3 | 32-4 | 9-4 | 38-4 |
| .11 | 81-1 | 46-3 | 44-3 | 14-4 | 31-4 |
| .13 | 91-1 | 49-3 | 47-4 | 12-4 | 12-4 |
| .15 | 97-0 | | 47-4 | 9-4 | |
| .22 | 97-0 | | 49-4 | 12-4 | 56-4 |
| .30 | 98-0 | 79-1 | 41-4 | | |
| .40 | 97-0 | 94-0 | | | 54-4 |
| 1.0 | 96-0 | 97-0 | 40-4 | 13-4 | 60-4 |

EXAMPLE 4

Nylon 66 flock (3 dpf/2 mm) was tested using stearic acid in water under high shear mixing conditions, the water containing calcium ion in various concentrations to evaluate dependence on calcium content. Fiber concentration was 20 g/l $H_2O$ at 160° F. Stearic acid was at a concentration of 0.10 g/l. Reaction time was 5 minutes to allow for equilibrium to be reached, pH of the water was 6.3.

Table 3

| Calcium Content (ppm) | % Flow | Static |
|---|---|---|
| 0 | 30 | 4 |
| .50±.05 | 45 | 3 |
| 1.0±.1 | 45 | 4 |
| 2.0±.2 | 89 | 2 |
| 3.0±.3 | 70 | 2 |
| 4.0±.4 | 72 | 2 |
| 5.0±.5 | 75 | 1 |
| 6.0±.6 | 95 | 1 |
| 7.0±.7 | 97 | 1 |
| 8.0±.8 | 95 | 0 |
| 10.0±1 | 96 | 0 |

Nylon 6 was found to respond in about the same way as Nylon 66.

EXAMPLE 5

When Nylon 66 fibers were treated with glycerol stearate, and stearic acid in deionized water, even at much higher concentrations, the results were very poor by comparison as shown in Table 4.

Table 4

| Conc. g/l | Stearic Acid % Flow-Static | Glycerol Stearate % Flow-Static |
|---|---|---|
| .00 | 4.6 - 4 | — |
| .025 | 6.0 - 4 | — |
| .05 | 6.6 - 4 | — |
| .1 | 5.4 - 4 | 42 - 4 |
| .2 | 9.0 - 4 | 51 - 4 |

Table 4-continued

| Conc. g/l | Stearic Acid % Flow-Static | Glycerol Stearate % Flow-Static |
|---|---|---|
| .4 | 8.9 - 4 | 20 - 4 |
| .8 | 10.0 - 4 | 57 - 4 |
| 1.0 | 12.2 - 4 | 18 - 4 |
| 1.6 | 12.0 - 4 | 24 - 4 |
| 2.0 | 10.0 - 4 | 21 - 4 |

These measurements were made on flock treated in water and the finish at 160° F, $H_2O$ and high shear mixing conditions to allow a maximum opportunity for reaction. Low temperature $H_2O$ gives approximately the same results.

EXAMPLE 6

Similar experiments were performed in the same manner as those reported in Table 3 using cupric and stannous ions and stearic acid. A range from 0 – 0.032 g/l (32 ppm) was covered. At the pH used (6.5) significant reaction should occur between the acid and the stannous and cupric ions. However, the stannous ion gave results which were not promising although the cupric ion gave a moderate increase in flow.

Table 5

| Conc. of Chloride Salt (ppm) | % Flow $CuCl_2$ | % Flow $SnCl_2$ |
|---|---|---|
| 0 | 17 - 4 | 10 - 4 |
| 4 | 06 - 4 | 9 - 4 |
| 8 | 04 - 4 | 6 - 4 |
| 16 | 24 - 4 | 6 - 4 |
| 32 | 39 - 4 | 6 - 4 |
| 64 | 41 - 4 | — |
| 128 | 42 - 4 | — |

In these cases, the reaction between the metal ion and the acid did not take place properly. When preformed salts were used as revealed below, the corresponding salts exhibited much better performance.

EXAMPLE 7

A study was made by a commercial mill which produces a flocked blanket, to determine differences in fiber waste between flock treated according to the present invention with calcium stearate and flock treated with a commercial finish. The fiber used was 3 dpf, 2 mm length Nylon 66. This study is based on consumption of 600,000 lbs. of the commercial fiber and 120,000 lbs. of the calcium stearate treated fiber.

Table 6

| Treatment | Balled Flocking Machine Waste | Drier Oven Waste | Surplus Unattached Flock Waste |
|---|---|---|---|
| Commercial | 6% | .92% | 10.5% |

Table 6-continued

| Treatment | Balled Flocking Machine Waste | Drier Oven Waste | Surplus Unattached Flock Waste |
|---|---|---|---|
| $CaSt_2$ | 0.5% | .31% | 0.6% |

EXAMPLE 8

Nylon 66 flock (2 dpf/3 mm) was treated with calcium salts and linear saturated aliphatic monocarboxylic acids of chain length as indicated below, at the indicated concentrations, in water at room temperature. The results were as follows:

Table 7

| Chain Length | Conc. (gyl) | % Flow | Comment |
|---|---|---|---|
| C-8 | .5 | 38 | Poor |
| | 1.0 | 43 | Poor |
| C-10 | .5 | 68 | Fair |
| | 1.0 | 91 | Excellent |
| C-12 | .5 | 90 | Excellent |
| | 1.0 | 95 | Excellent |
| C-14 | .5 | 81 | Good |
| | 1.0 | 95 | Excellent |
| C-16 | .5 | 93 | Excellent |
| | 1.0 | 95 | Excellent |
| C-18 | .5 | 95 | Excellent |
| | 1.0 | 96 | Excellent |

EXAMPLE 9

Additional experiments were carried out with a variety of metal salts on Nylon 66 (2 dpf/3 mm) and percent flow was measured. The flock was at a concentration of 20 g/l, in deionized water at 140° F. The results were as follows.

Table 8

| | SALT | | | | | | | | | | | | | |
|---|---|---|---|---|---|---|---|---|---|---|---|---|---|---|
| Conc g/l | Barium Distearate | Nickel Tristearate | Ferric Stearate | Stannous Stearate* | Cupric Stearate | Manganese Distearate | Plumbous Stearate | Lithium Stearate | Sodium Stearate | Calcium Laurate | Calcium Palmitate | Aluminum Tristearate | Aluminum Monochloride Distearate | Aluminum Dichloride Monostearate |
| .1 | 68% | 48% | 47% | 55% | 94% | 56% | 76% | 37% | Foam | 75% | 84% | 31% | 37% | 30% |
| .2 | 97% | 30% | 53% | 67% | 94% | 57% | 77% | 77% | Foam | 89% | 94% | 44% | 40% | 41% |
| .4 | 97% | 30% | 58.7% | 4.4% | 94% | 87% | 97% | 49% | Foam | 91% | 93% | 46% | 46% | 36% |
| .8 | 97% | 49% | 43% | 24% | 88% | 90% | 97% | 38% | Foam | 93% | 94% | 42% | 54% | 56% |
| 1.2 | 97% | 39% | 55% | 24% | 90% | 90% | 92% | 49% | Foam | 94% | 95% | 52% | 47% | 58% |
| 1.6 | 97% | 30% | 69% | 31% | 90% | 90% | 97% | 38% | Foam | 94% | 94% | 49% | 52% | 65% |
| 2.0 | 95% | 45% | 73% | 44% | 90% | 89% | 92% | 31% | Foam | 94% | 96% | 50% | 55% | 64% |
| 4.0 | 94% | 63% | 82% | 44% | 95% | 89% | 95% | 47.3% | Foam | 90% | 91% | 51% | 43% | 75% |

*Believed to be unstable, to form stannic stearate.

Quantitative extraction of flock treated in accordance with the present invention, taken with observations of the hydrophobic nature of the finished flock, is evidence that the hydrophobic $CH_3$—ends of the acid molecules are exposed and the hydrophilic ends are attached to the flock. However, this hydrophobic property of the flock does not interfere with adhesion to water based adhesives when the flock is deposited onto a web.

The amount of acid and/or salt deposited on the flock has not been determined precisely. However, it is estimated to be about 0.1% by weight based on chemical extractions of the flock.

The present invention was the result of a series of experiments in which a wide variety of conventional yarn finishes were evaluated for possible usefulness in the treatment of flock. The finishes were applied to the flock using a high shear mixer and hot water as described above. Of the many tested, one finish (Lauravel SC Conc., Laurel Soap Mfg. Co., Inc., Philadelphia, Pa.) showed promise when applied in this way. It was analyzed and its various components were evaluated. It was found that certain long chain fatty acids in that finish were effective whereas other components were not. Further investigation revealed that the effectiveness of the acids was dependent on the presence of metal ions in the water used to apply the finish and the use of high shear mixing, apparently causing the ions to react with the acid. Consequently, metal salts of those acids were evaluated and found to be effective and an especially useful material for the process.

What is claimed is:

1. A method for the treatment of flock which comprises suspending the flock in water which contains a linear, saturated aliphatic monocarboxylic acid having at least 8 carbon atoms and a metal ion, in an amount sufficient to increase the flow of said flock, at least partially in the form of a salt of said acid and said metal, and separating and drying the flock.

2. A method for the treatment of flock as set forth in claim 1 wherein the metal ion is a divalent metal ion.

3. A method for the treatment of flock as set forth in claim 2 wherein the divalent metal ion is a metal of Group II of the Periodic Table of Elements.

4. A method for the treatment of flock as set forth in claim 3 wherein said metal ion is calcium.

5. A method for the treatment of flock as set forth in claim 1 wherein said acid contains at least 10 carbon toms.

6. A method for the treatment of flock as set forth in claim 5 wherein said acid contains at least 12 carbon atoms.

7. A method for the treatment of flock as set forth in claim 6 wherein said acid contains 14 to 20 carbon atoms.

8. A method for the treatment of flock as set forth in claim 7 wherein said acid comprises stearic acid.

9. A method for the treatment of flock as set forth in claim 8 wherein the flock is treated with calcium stearate.

10. A method for the treatment of flock as set forth in claim 9 wherein the calcium stearate is preformed prior to introduction into said water.

11. A method for the treatment of flock as set forth in claim 1 wherein the flock is a synthetic or man-made textile.

12. A method for the treatment of flock as set forth in claim 11 wherein the flock is selected from the group consisting of polyester, polyamide, polyolefin, rayon, cellulose acetate and cellulose triacetate.

13. A method for the treatment of flock as set forth in claim 12 wherein the flock is polyamide.

14. A method for the treatment of flock as set forth in claim 13 wherein the flock is nylon 66.

15. A method for the treatment of flock as set forth in claim 1 wherein the flock is 1.5 to 40 dpf and 0.5 to 15 mm long.

16. A method for the treatment of flock as set forth in claim 15 in which the flock is 3–15 dpf and 1–8 mm long.

17. A method for the treatment of flock as set forth in claim 16 wherein the flock is 3 dpf and 2 mm long.

18. A method for the treatment of flock as set forth in claim 1 wherein the amount of said acid is 0.025 to 0.3 g/liter of water.

19. A method for the treatment of flock as set forth in claim 1 wherein the acid and metal ion are introduced into said water as a preformed salt.

20. Flock which has been treated by the method of claim 1.

21. A method for the treatment of nylon 66 flock which is 3 dpf, 2 mm long, which comprises suspending 20 grams per liter of the flock in water to which has been added at least 0.1 gram per liter of preformed calcium stearate, and separating and drying the flock.

22. A method for the treatment of flock which comprises agitating, under high shear mixing conditions, water which contains at least about 3 parts per million of a metal ion and a linear, saturated, aliphatic, monocarboxylic acid containing at least 8 carbon atoms, suspending flock in the water, and separating and drying the flock.

* * * * *